US006439215B1

(12) United States Patent
Sato et al.

(10) Patent No.: US 6,439,215 B1
(45) Date of Patent: Aug. 27, 2002

(54) BREATHER STRUCTURE IN FOUR-CYCLE ENGINE FOR WORK MACHINES

(75) Inventors: Yoshikazu Sato; Shinji Katayama; Yukio Sugimoto, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/916,312

(22) Filed: Jul. 30, 2001

(30) Foreign Application Priority Data

Aug. 10, 2000 (JP) ..... 2000-247946

(51) Int. Cl.[7] ..... F01M 11/02; F01M 13/00
(52) U.S. Cl. ..... 123/572
(58) Field of Search ..... 123/572, 573, 123/574

(56) References Cited

U.S. PATENT DOCUMENTS

| | | | | |
|---|---|---|---|---|
| 4,103,650 A | * | 8/1978 | Nishida et al. | 123/572 |
| 4,721,090 A | * | 1/1988 | Kato | 123/572 |
| 5,951,344 A | * | 9/1999 | Tsunoda et al. | 123/572 |
| 5,960,764 A | | 10/1999 | Araki | 123/196 R |

FOREIGN PATENT DOCUMENTS

| | | |
|---|---|---|
| DE | 197 36 040 | 2/1999 |
| EP | 0 962 630 | 5/1999 |
| JP | 1-51647 | 11/1989 |

* cited by examiner

*Primary Examiner*—Marguerite McMahon
(74) *Attorney, Agent, or Firm*—Armstrong, Westerman & Hattori, LLP

(57) ABSTRACT

In order to prevent lubricating oil from entering an intake system when an engine body is tilted downward while avoiding any increase in the engine dimensions, the engine body has first and second breather chambers, first and second through passages for providing communication between a crank chamber and the first and second breather chambers, respectively, and a communicating passage for providing communication between the first and second breather chambers. The second breather chamber is connected to the intake system via a guide pipe, an end of the second through passage that opens inside the crank chamber is positioned above the oil surface inside the crank chamber when the engine is tilted downward, and the route from the first through passage to the communicating passage via the first breather chamber is shaped so as to prevent the lubricating oil inside the crank chamber from entering the communicating passage.

2 Claims, 7 Drawing Sheets

11
12
13
16
64
65
66
67
68
69
86
L

BREATHER STRUCTURE IN FOUR-CYCLE ENGINE FOR WORK MACHINES

BACKGROUND OF THE INVENTION

1. Field of the Invention

The present invention relates to a four-cycle engine for driving a work machine such as a trimmer, a grass cutter or a rammer and, in particular, an improvement in a breather structure in a four-cycle engine for a work machine wherein a crankcase of an engine body rotatably supports a crankshaft linked to the work machine, lubricating oil is stored in a crank chamber formed inside the crankcase, and an intake system is connected to a cylinder head of the engine body, the axis of a cylinder bore of the engine body being almost vertical when the work machine is being used.

2. Description of the Related Art

The attitude of a work machine such as a trimmer, a grass cutter or a rammer varies from when it is operating to when it is not operating. The oil surface inside the crank chamber also varies from when it is operating to when it is not operating. It is therefore necessary to arrange the breather structure for guiding breather gas from the crank chamber into an intake system so that the lubricating oil is prevented from entering the intake system when it is not operating. A breather structure arranged from the above-mentioned point of view is disclosed in, for example, Japanese Patent Publication No. 1-51647.

The above-mentioned Japanese Patent Publication No. 1-51647 discloses a breather structure that prevents the lubricating oil from entering the intake system even when the engine body is turned over through 360 degrees. In this breather structure, a mist separator that is separate from the engine body is connected to the upper part of a cylinder head via a first check valve that closes when the engine body turns over and to the lower part of a cylinder block via a second check valve that closes when the engine body turns over. Since the mist separator is placed at a position away from the engine body, the overall dimensions of the engine increase. Moreover, in an engine for a work machine such as a grass cutter or a rammer, the engine body may be tilted thereby making the cylinder bore axis almost horizontal when the machine is not being used. It is therefore necessary to prevent the lubricating oil from entering the intake system under conditions where the engine body is tilted downward. However, the technique disclosed in the above-mentioned publication cannot deal with such a state where the engine body is tilted downward.

SUMMARY OF THE INVENTION

The present invention has been carried out in view of the above-mentioned circumstances, and it is an object of the present invention to provide a breather structure in a four-cycle engine for a work machine that can prevent the lubricating oil from entering the intake system when the engine body is tilted downward while avoiding any increase in the overall engine dimensions.

In order to achieve the above-mentioned object, in accordance with a first aspect of the present invention, there is proposed a breather structure in a four-cycle engine for a work machine in which a crankcase of the engine body rotatably supports a crankshaft linked to the work machine, lubricating oil is stored in a crank chamber formed inside the crankcase, and an intake system is connected to a cylinder head of the engine body, an axis of a cylinder bore of the engine body being almost vertical when the work machine is being used, wherein the breather structure includes: a first breather chamber; a first through passage for providing communication between the first breather chamber and the crank chamber; a second breather chamber placed in the vicinity of the intake system on the side approximately opposite the first breather chamber relative to the axis of the cylinder bore; a second through passage for providing communication between the second breather chamber and the crank chamber; and a communicating passage for providing communication between the first and second breather chambers, the first breather chamber, the first through passage, the second breather chamber, the second through passage and the communicating passage being provided in the engine body so that the first and second through passages communicate with the lower parts of the first and second breather chambers that are positioned above the oil surface inside the crank chamber when the work machine is being used and the communicating passage opens into the upper part of the second breather chamber. A guide pipe that communicates with the upper part of the second breather chamber when the work machine is being used is connected to the intake system, the second through passage is formed such that an open end of the second through passage inside the crank chamber is positioned above the oil surface inside the crank chamber regardless of the attitude of the engine body when the engine body is tilted downward such that the axis of the cylinder bore becomes almost horizontal, and the route from the first through passage to the communicating passage via the first breather chamber being made in a shape that prevents the lubricating oil inside the crank chamber from entering the communicating passage when the engine body is tilted downward such that the communicating passage is positioned beneath the axis of the cylinder bore.

In accordance with the above-mentioned arrangement, when the work machine is being used, breather gas that is generated inside the crank chamber is guided to the intake system via the first through passage, the first breather chamber, the communicating passage, the second breather chamber and the guide pipe and is guided to the intake system via the second through passage, the second breather chamber and the guide pipe. The lubricating oil separated from the breather gas inside the first and second breather chambers is returned to the crank chamber through the first and second through passages. Because the second through passage is formed such that its open end inside the crank chamber is positioned above the oil surface inside the crank chamber regardless of the attitude of the engine body when the engine body is tilted downward such that the axis of the cylinder bore becomes almost horizontal when the work machine is not being used, it is possible to prevent the lubricating oil inside the crank chamber from entering the second breather chamber via the second through passage. Moreover, the route from the first through passage to the communicating passage via the first breather chamber is shaped so as to prevent the lubricating oil inside the crank chamber from entering the communicating passage even when the engine body is tilted downward so that the communicating passage is positioned beneath the axis of the cylinder bore. The lubricating oil inside the crank chamber therefore does not enter the second breather chamber from the first through passage via the first breather chamber and the communicating passage. In this way, the lubricating oil inside the crank chamber can be prevented from entering the second breather chamber regardless of the attitude of the engine body when it is tilted downward so that the axis of the cylinder bore becomes almost horizontal, and the lubricating oil can reliably be prevented from entering the intake system. Furthermore, because the first and second breather chambers are provided in the engine body, the overall dimensions of the engine do not increase when using the above-mentioned arrangement for preventing the lubricating oil from entering the intake system.

Furthermore, in accordance with a second aspect of the present invention, in addition to the above-mentioned first aspect, the second through passage is formed from a passage hole that is directly provided in the engine body so as to communicate with the second breather chamber and a pipe that is secured to the engine body so as to communicate with the passage hole.

In accordance with the above-mentioned arrangement, the second through passage, which has a complex shape so that its open end is positioned above the oil surface inside the crank chamber regardless of the attitude of the engine body when the engine body is tilted over such that the axis of the cylinder bore becomes almost horizontal, can be formed by a simple arrangement.

The above-mentioned objects, other objects, characteristics and advantages of the present invention will become apparent from an explanation of a preferable embodiment that will be described in detail below by reference to the attached drawings

BRIEF DESCRIPTION OF THE DRAWINGS

FIGS. 1 to 7 illustrate a preferred exemplary embodiment of the present invention.

FIG. 1 is a longitudinal sectional view of an engine.

FIG. 2 is a cross-sectional view taken along a line 2—2 in FIG. 1.

FIG. 3 is a bottom view of an engine block taken in the direction of arrow 3 in FIG. 1.

FIG. 4 is an enlarged cross-sectional view taken along a line 4—4 in FIG. 1.

FIG. 5 is an enlarged cross-sectional view taken along a line 5—5 in FIG. 2.

FIG. 6 is an enlarged cross-sectional view taken along a line 6—6 in FIG. 2.

DETAILED DESCRIPTION OF THE PREFERRED EMBODIMENT

Figure 1:
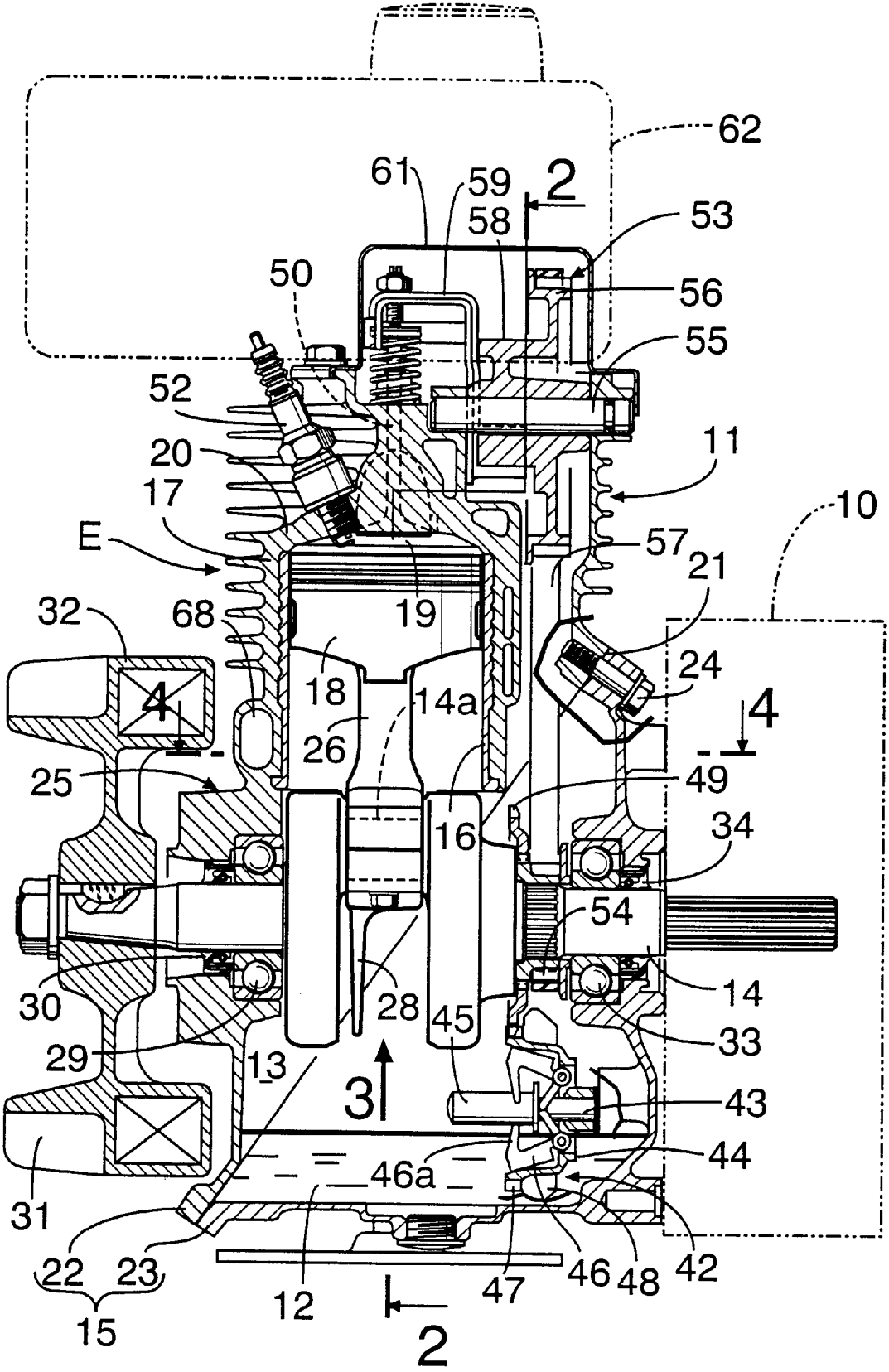
Figure 2:
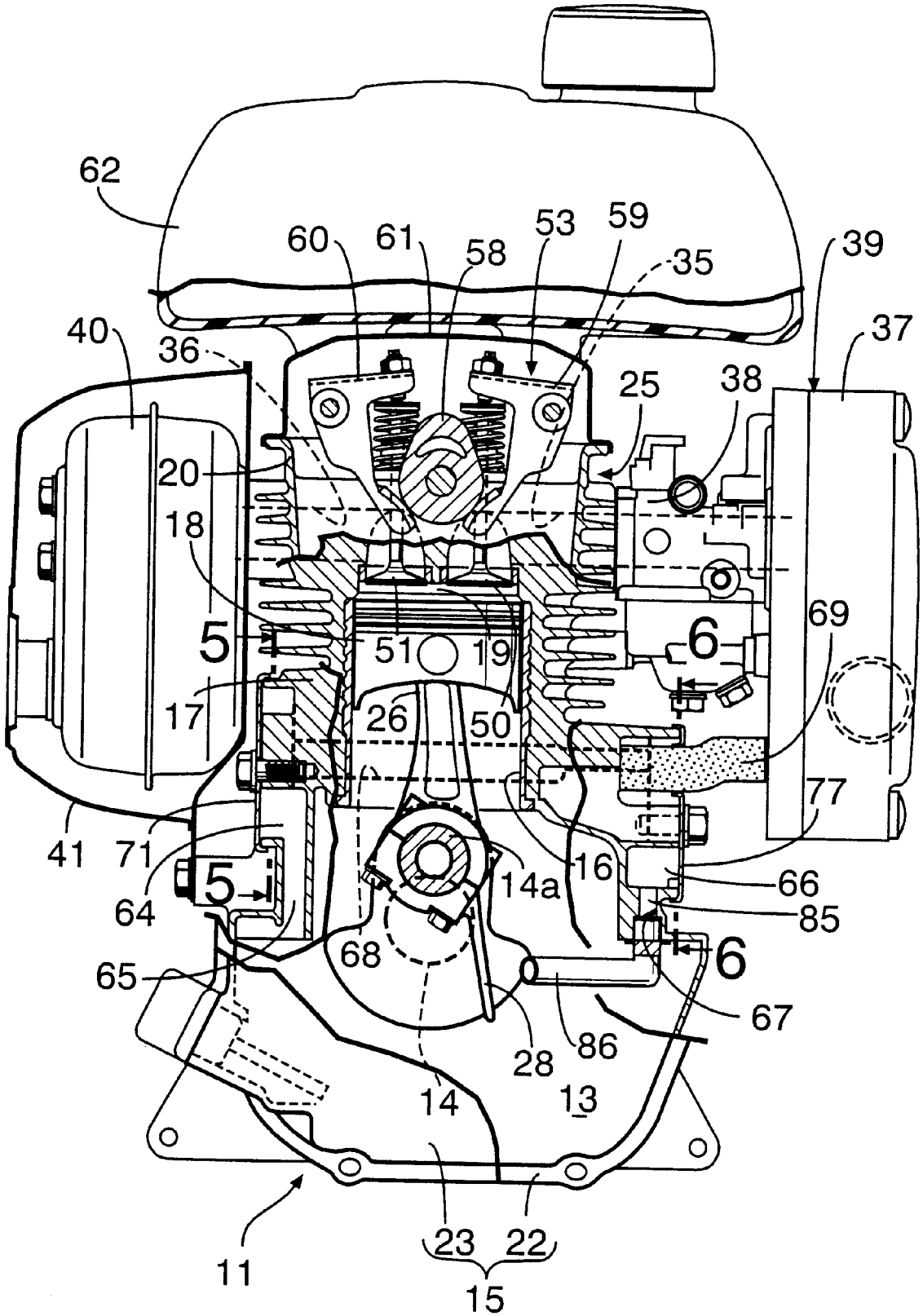

A preferred exemplary embodiment of the present invention is explained below by reference to FIGS. 1 to 7. Firstly in FIGS. 1 and 2, an engine body 11 of a four-cycle engine E for driving a rammer 10, which is a work machine, has a crankcase 15, a cylinder barrel 17 and a cylinder head 20. The crankcase 15 forms a crank chamber 13 for storing lubricating oil 12 and supports a crankshaft 14 having its axis generally horizontal when the above-mentioned rammer 10 is being used. The cylinder barrel 17 includes a cylinder bore 16 having its axis generally vertical when the above-mentioned rammer 10 is being used. The cylinder head 20 together with the top of a piston 18, which is slidably fitted in the cylinder bore 16, forms a combustion chamber 19.

The crankcase 15 has a first case half 22 and a second case half 23 that are joined to each other by a plurality of bolts 24 and can be separated from each other on a dividing plane 21 that lies at an angle to the axis of the crankshaft 14. An engine block 25 is formed by integrally casting the first case half 22 and the above-mentioned cylinder barrel 17 and cylinder head 20.

The piston 18 is linked to a crank pin 14*a* of the crankshaft 14 via a connecting rod 26. An oil dipper 28 for scattering the lubricating oil 12 inside the crank chamber 13 is made integrally with a big end of the connecting rod 26.

One end of the crankshaft 14 projects outside the crankcase 15 through a ball bearing 29 and an annular sealing member 30 that are present between the crankshaft 14 and the first case half 22. A flywheel 32 having an integral cooling fan 31 is fixed to the end of the crankshaft 14 outside the crankcase 15.

The other end of the crankshaft 14 projects outside the crankcase 15 through a ball bearing 33 and an annular sealing member 34 that are present between the crankshaft 14 and the second case half 23. The rammer 10 is connected to this other end of the crankshaft 14 outside the crankcase 15.

The cylinder head 20 includes an intake port 35 and an exhaust port 36, which are able to communicate with the combustion chamber 19. An intake system 39 including an air cleaner 37 and a carburetor 38 is supported on the cylinder head 20 so as to communicate with the intake port 35. A muffler cover 41 covers an exhaust muffler 40, which communicates with the exhaust port 36, and the engine block 25 supports the muffler cover 41.

A centrifugal governor 42 for speed adjustment is mounted on the second case half 23 at a position that lies beneath the crankshaft 14 when the rammer 10 is being used. This centrifugal governor 42 has a rotating disc 44, a tubular slider 45 and a plurality of pendular type centrifugal weights 46. The rotating disc 44 is rotatably supported by a support shaft 43 fixed to the inside of the second case half 23. The slider 45 is slidably fitted around the support shaft 43. The centrifugal weights 46 are swingably supported on the rotating disc 44 so as to hold the slider 45. Each of the centrifugal weights 46 has an operation arm 46*a* that slides the slider 45 in one direction when the centrifugal force makes the centrifugal weights 46 swing outward in the radial direction of the rotating disc 44.

A driven gear 47 and lubricating oil scattering vanes 48 are formed integrally with the outer periphery of the rotating disc 44. The driven gear 47 meshes with a drive gear 49 fixed to the crankshaft 14. The above-mentioned support shaft 43 is provided on the second case half 23 at a position such that the above-mentioned scattering vanes 48 are immersed in the lubricating oil 12 inside the crank chamber 13.

In this type of centrifugal governor 42 for speed adjustment, the rotating disc 44 rotates accompanying rotation of the crankshaft 14, and the slider 45 accordingly slides in one axial direction of the support shaft 43. The sliding action of the slider 45 is then transmitted to a throttle valve (not illustrated) of the carburetor 38 via a link (not illustrated) so as to control the rotational rate of the engine at a set rotational rate.

An intake valve 50 and an exhaust valve 51 are provided in the cylinder head 20 in a manner such that they can freely open and close, and a spark plug 52 facing the combustion chamber 19 is mounted in the cylinder head 20. The intake valve 50 controls communication and shut off between the intake port 35 and the combustion chamber 19. The exhaust valve 51 controls communication between the combustion chamber 19 and the exhaust port 36.

The above-mentioned intake valve 50 and exhaust valve 51 are opened and closed by a valve operation mechanism 53. The valve operation mechanism 53 has a drive timing pulley 54, a driven timing pulley 56, an endless timing belt 57, a cam 58 and rocker arms 59 and 60. The drive timing pulley 54 is fixed to the crankshaft 14 together with the above-mentioned drive gear 49. The driven timing pulley 56 is supported by a shaft 55 supported in the cylinder head 20. The endless timing belt 57 is wound around the drive timing pulley 54 and the driven timing pulley 56. The cam 58 is provided so as to be connected to the above-mentioned driven timing pulley 56. The rocker arms 59 and 60 are provided between the cam 58 and the intake valve 50 and the exhaust valve 51, respectively. The rocker arms 59 and 60 are swingably carried in a head cover 61 made of a synthetic resin. The head cover 61 is joined to the cylinder head 20 so as to cover a part of the valve operation mechanism 53. A fuel tank 62 is formed integrally with the head cover 61.

Figure 3:
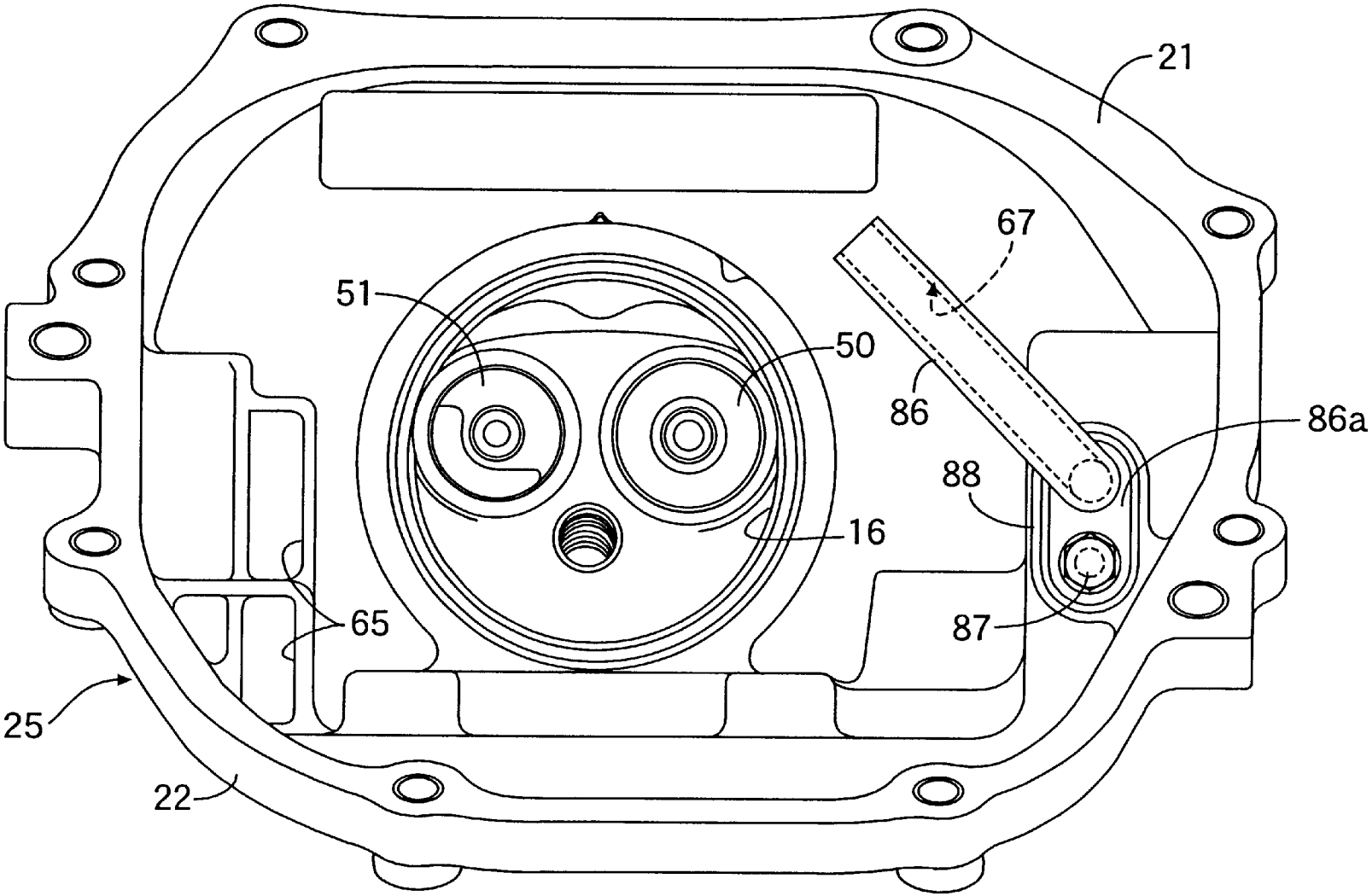
Figure 4:
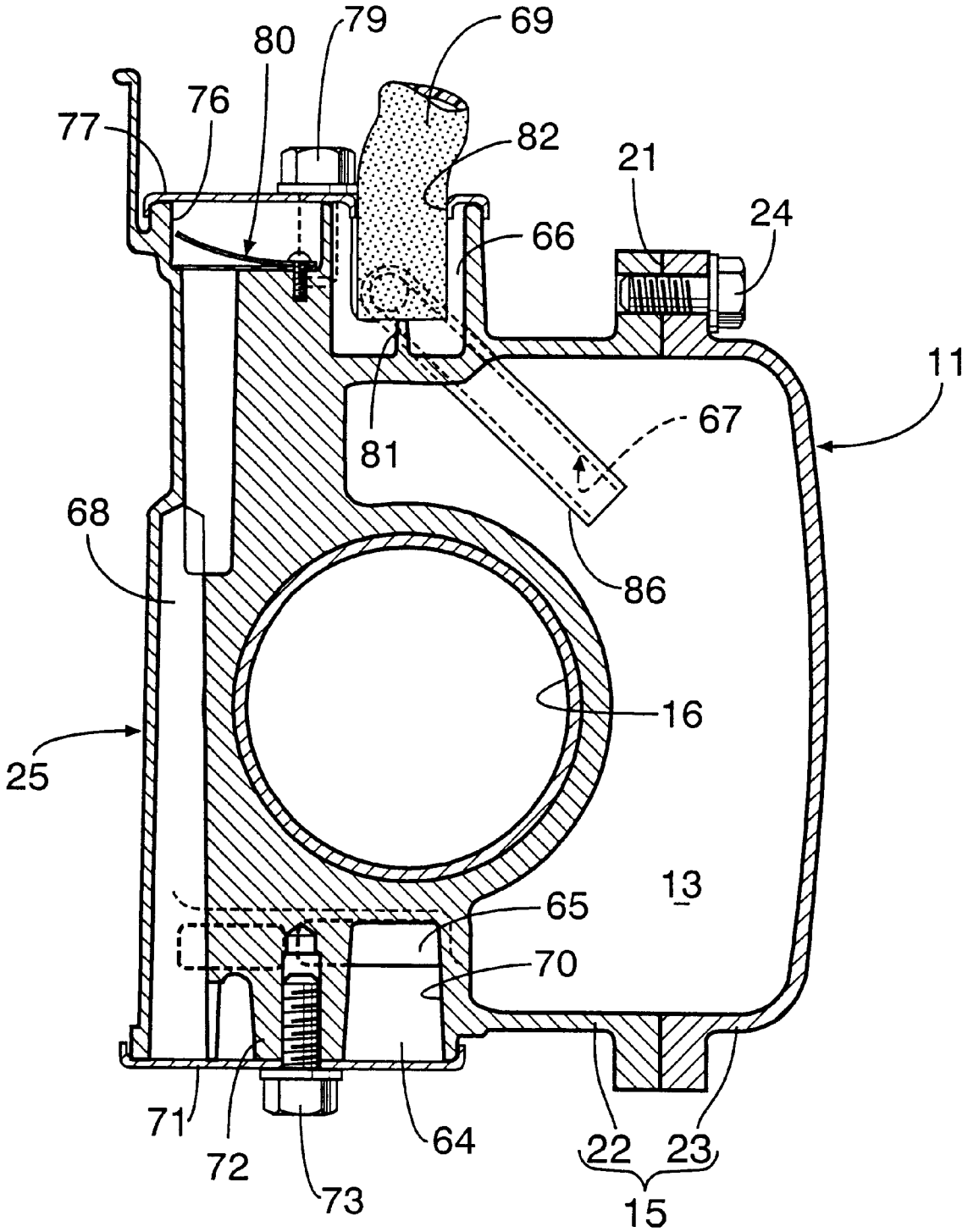

In FIGS. 3 and 4, the engine block 25 of the engine body 11 includes a first breather chamber 64, a first through passage 65, a second breather chamber 66, a second through passage 67 and a communicating passage 68 for providing communication between the first and second breather chambers 64 and 66. The first breather chamber 64 is placed at a position that is approximately 180 degrees away from the position corresponding to the above-mentioned intake system 39 along the circumferential direction of the above-mentioned cylinder bore 16. The first through passage 65 provides communication between the first breather chamber 64 and the crank chamber 13. The second breather chamber 66 is placed in the vicinity of the intake system 39 on the side approximately opposite to the first breather chamber 64 relative to the axis of the cylinder bore 16. The second through passage 67 provides communication between the second breather chamber 66 and the crank chamber 13. The second breather chamber 66 is connected to the air cleaner 37 of the intake system 39 via a guide pipe 69, which can be, for example, a rubber hose.

Figure 5:
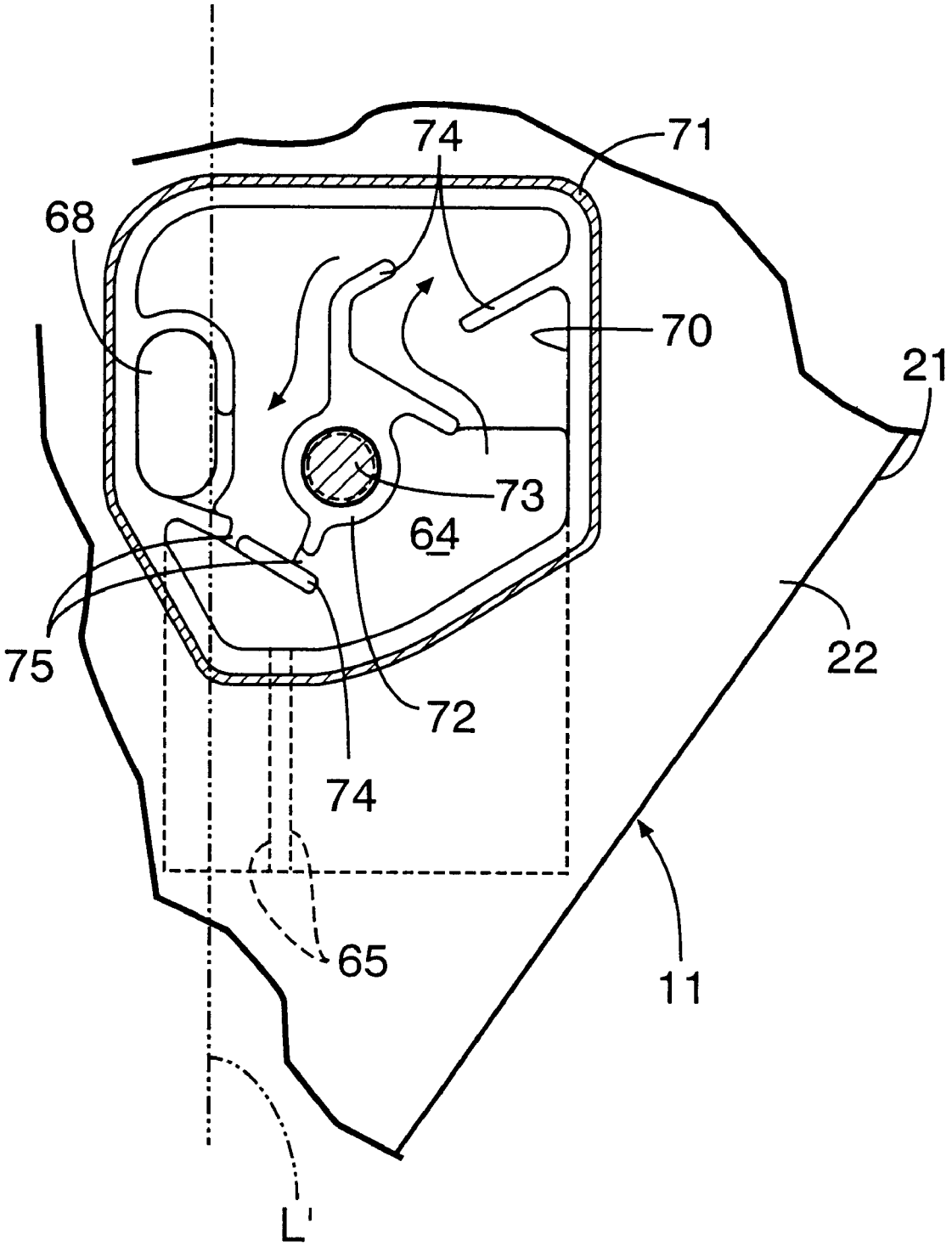

Referring additionally to FIG. 5, a cavity 70 is provided on the outside of the first case half 22 of the engine block 25 on the side opposite to the intake system 39 side. A cover 71 covering the cavity 70 is joined to the outside of the first case half 22. In this way, the first breather chamber 64 is formed between the first case half 22 and the cover 71 so that the first breather chamber 64 is positioned above the oil surface inside the crank chamber 13 when the rammer 10 is being used, and the first through passage 65 is provided in the first case half 22 so that the first through passage 65 communicates with the lower part of the first breather chamber 64 when the rammer 10 is being used, and the open end of the first through passage 65 is split into two in the crank chamber 13.

The communicating passage 68 is provided in the first case half 22 so as to be positioned on a plane that is perpendicular to the axis of the cylinder bore 16. One end of the communicating passage 68 opens inside the above-mentioned cavity 70 so as to communicate with the first breather chamber 64.

A boss 72 is provided so as to project from the outside of the first case half 22 in approximately the centre of the above-mentioned cavity 70. The cover 71 is secured to the first case half 22 by a bolt 73 screwed into the boss 72. A plurality of labyrinth-forming walls 74 are provided on the outside of the first case half 22 inside the cavity 70 so as to be in contact with the cover 71. A labyrinth providing a connection between the first through passage 65 and the communicating passage 68 is formed inside the first breather chamber 64 by these labyrinth-forming walls 74. Breather gas introduced into the first breather chamber 64 via the first through passage 65 from the crank chamber 13 when the rammer 10 is being used thereby circulates through the above-mentioned labyrinth inside the first breather chamber 64 and then reaches the communicating passage 68. The changes in direction of circulation of the breather gas in the above-mentioned labyrinth allow the accompanying lubricating oil to be separated from the breather gas. Moreover, return holes 75 that have a reduced circulation area so as to suppress the circulation of breather gas through them as much as possible are provided on the labyrinth-forming wall 74 positioned below the open end of the communicating passage 68 in a section on the communicating passage 68 side of the above-mentioned labyrinth in order to return the lubricating oil so separated to the first through passage 65 side.

Figure 6:
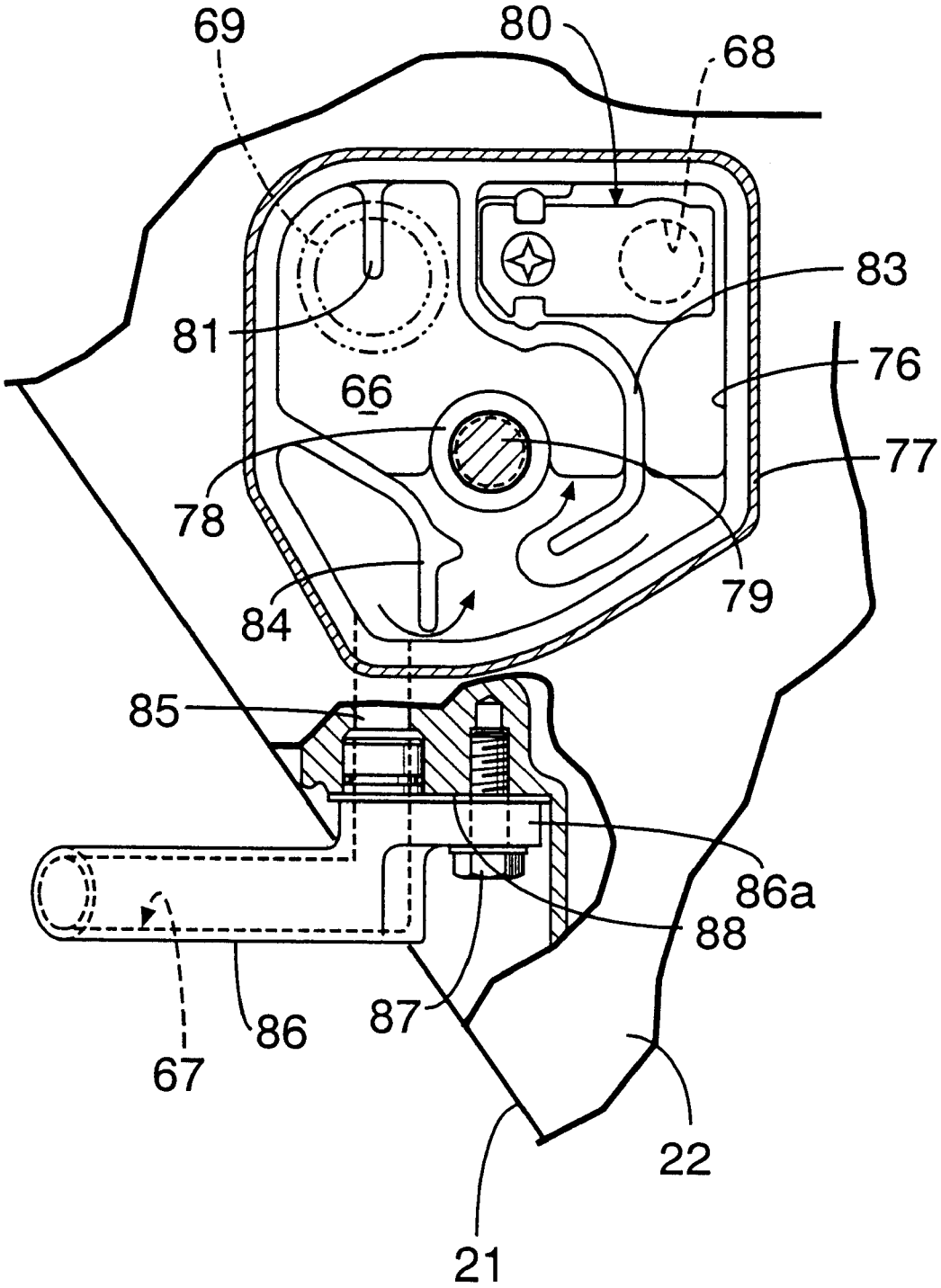

Referring additionally to FIG. 6, a cavity 76 is provided on the outside of the first case half 22 of the engine block 25 in the vicinity of the above-mentioned intake system 39 on the side approximately opposite to the first breather chamber 64 relative to the axis of the cylinder bore 16. A cover 77 covering the cavity 76 is joined to the outside of the first case half 22. In this way, the second breather chamber 66 is formed between the first case half 22 and the cover 77 so that the second breather chamber 66 is positioned above the oil surface inside the crank chamber 13 when the rammer 10 is being used. The other end of the communicating passage 68 opens into the cavity 76 so as to communicate with the upper part of the second breather chamber 66 when the rammer 10 is being used.

A boss 78 is provided so as to project from the outside of the first case half 22 in approximately the centre of the above-mentioned cavity 76. The cover 77 is secured to the first case half 22 by a bolt 79 that is screwed into the boss 78. A reed valve 80 is attached to the first case half 22 inside the cavity 76 so as to close the open end of the above-mentioned communicating passage 68. The reed valve 80 prevents the breather gas from circulating into the communicating passage 68 side from the second breather chamber 66.

A projection 81 is provided on the outside of the first case half 22 in a section beside the communicating passage 68 in the upper part of the second breather chamber 66 when the rammer 10 is being used. The projection 81 receives one end of the guide pipe 69, which is inserted with an air-tight fit into a through hole 82 provided in the cover 77. The projection 81 is provided so as not to completely close the open end of the guide pipe 69. The other end of the guide pipe 69 is connected to the air cleaner 37 of the intake system 39.

Labyrinth-forming walls 83 and 84 are provided on the outside of the first case half 22 inside the cavity 76 so as to be in contact with the cover 77. A labyrinth is formed inside the second breather chamber 66 by the labyrinth-forming wall 83 so as to provide a connection between the communicating passage 68 and the guide pipe 69. Another labyrinth providing a connection between the second through passage 67 and the guide pipe 69 is formed inside the second breather chamber 66 by the other labyrinth-forming wall 84.

The second through passage 67 communicates with the lower part of the second breather chamber 66 when the rammer 10 is being used. The second through passage 67 is formed from a passage hole 85 that is directly provided in the first case half 22 so as to communicate with the second breather chamber 66 and a pipe 86 that is secured to the first case half 22 so as to communicate with the passage hole 85. A flat mounting seat 88 facing the crank chamber 13 is formed in a section of the first case half 22 that lies beneath the second breather chamber 66 when the rammer 10 is being used. The through hole 85 is provided in the first case half 22 so as to connect the second breather chamber 66 to the mounting seat 88. The pipe 86 has a flange 86*a* that is in contact with the mounting seat 88, and is formed so as to be approximately L-shaped. The flange 86*a* is secured to the mounting seat 88 by a bolt 87. One end of the pipe 86 is inserted with a liquid-tight fit into one end of the passage hole 85 on the mounting seat 88 side.

Figures 7A, 7B, 7C, 7D:
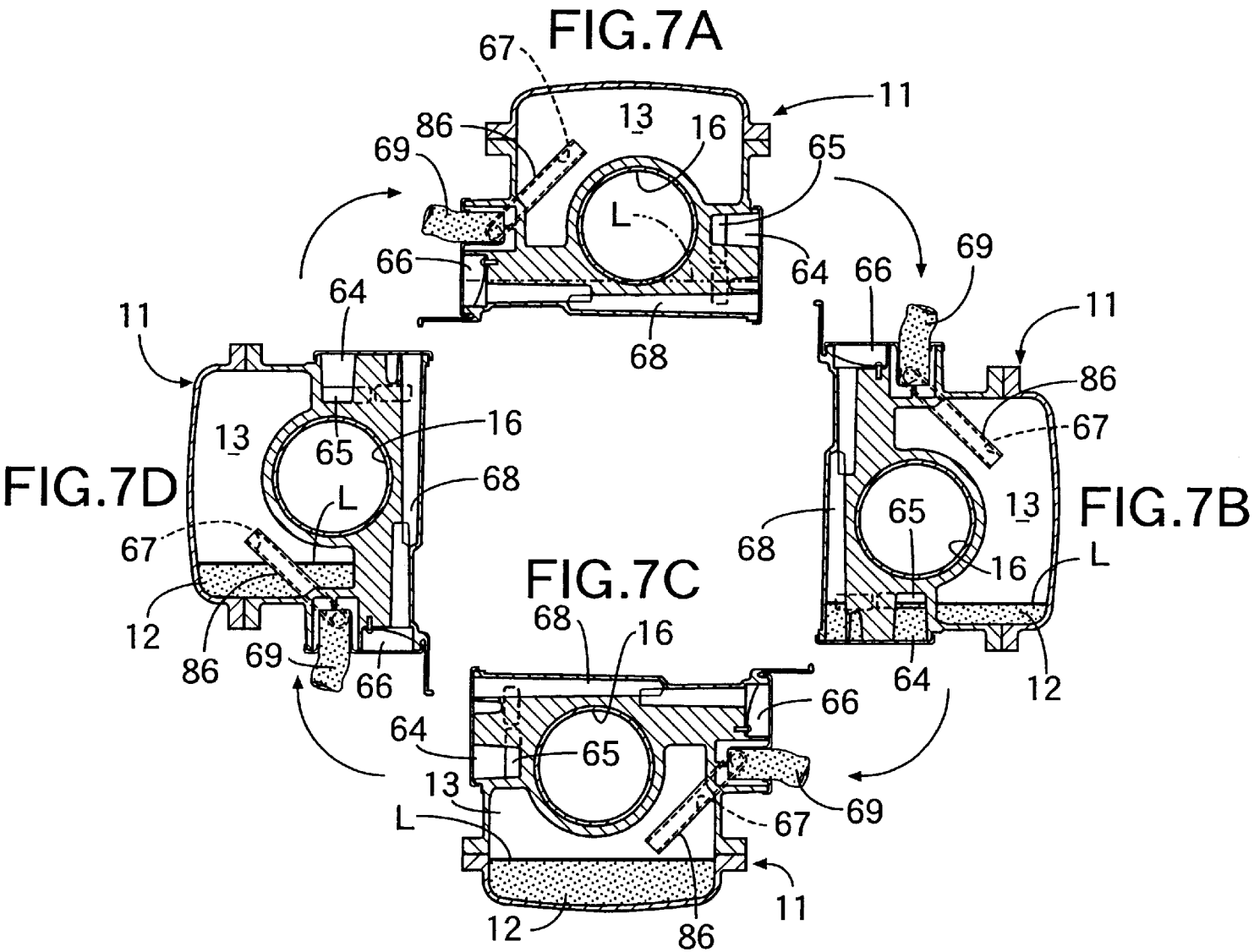
FIGS. 7A to 7D are cross-sectional views showing states in which the attitude of an engine body that has been laid down is changed by 90 degrees each time.

When the rammer 10 is not being used, the engine body 11 may be tilted downward so that the axis of the cylinder bore 16 becomes almost horizontal, as shown in FIG. 7. The second through passage 67 is therefore formed so that the open end thereof inside the crank chamber 13 is positioned above the oil surface L inside the crank chamber 13 regardless of the attitude of the engine body 11 shown in FIGS. 7A to 7D when the engine body 11 is tilted downward so that the axis of the cylinder bore 16 becomes almost horizontal.

When the engine body 11 is in a downward-tilted state such that the communicating passage 68 is positioned beneath the axis of the cylinder bore 16, that is, in the state shown in FIG. 7A, the oil surface L of the lubricating oil 12 is at a position that allows the lubricating oil 12 to enter the first breather chamber 64 via a part of the first through passage 65. There is therefore a possibility that the lubricating oil 12 could flow from the first breather chamber 64 to the second breather chamber 66 side via the communicating passage 68. However, the route from the first through passage 65 to the communicating passage 68 via the first breather chamber 64 is made in a shape that can prevent the lubricating oil 12 inside the crank chamber 13 from entering the communicating passage 68. That is, in this embodiment, when the engine body 11 is tilted downward such that the communicating passage 68 is positioned beneath the axis of the cylinder bore 16, the oil surface is at a position denoted by the broken line L' in FIG. 5, and each of the labyrinth-forming walls 74 provided in the first case half 22 so as to form a labyrinth inside the first breather chamber 64 is made in a shape that prevents the lubricating oil 12 that has flowed into the first breather chamber 64 via the first through passage 65 from entering the communicating passage 68.

The action of this embodiment is explained below. The first case half 22 of the engine body 11 includes the first breather chamber 64, the first through passage 65 for providing communication between the first breather chamber 64 and the crank chamber 13, the second breather chamber 66 positioned in the vicinity of the intake system 39 on the side approximately opposite to the first breather chamber 64 relative to the axis of the cylinder bore 16, the second through passage 67 for providing communication between the second breather chamber 66 and the crank chamber 13, and the communicating passage 68 that provides communication between the first and second breather chambers 64 and 66. The first and second through passages 65 and 67 are connected to the lower parts of the first and second breather chambers 64 and 66 that are positioned above the oil surface inside the crank chamber 13 when the rammer 10 is being used. The communicating passage 68 is positioned so as to open into the upper part of the second breather chamber 66. The air cleaner 37 of the intake system 39 is connected to the guide pipe 69, which communicates with the upper part of the second breather chamber 66 when the rammer 10 is being used.

When the rammer 10 is being used, breather gas that is generated inside the crank chamber 13 is therefore guided to the intake system 39 via the first through passage 65, the first breather chamber 64, the communicating passage 68, the second breather chamber 66 and the guide pipe 69 and is guided to the intake system 39 via the second through passage 67, the second breather chamber 66 and the guide pipe 69.

Each of the first and second breather chambers 64 and 66 has a labyrinth inside it. The lubricating oil separated from the breather gas as it circulates through these labyrinths is returned to the crank chamber 13 through the first and second through passages 65 and 67, thus enhancing the gas-liquid separation performance.

Furthermore, the second through passage 67 is formed so that its open end inside the crank chamber 13 is positioned above the oil surface L inside the crank chamber 13 regardless of the attitude of the engine body 11 when the engine body 11 is tilted downward so that the axis of the cylinder bore 16 becomes almost horizontal. It is therefore possible to prevent the lubricating oil 12 inside the crank chamber 13 from entering the second breather chamber 66 via the second through passage 67 regardless of the attitude of the engine body 11 when the engine man body 11 is tilted downward so that the axis of the cylinder bore 16 becomes almost horizontal while the rammer 10 is not being used.

Moreover, the route from the first through passage 65 to the communicating passage 68 via the first breather chamber 64 is made in a shape that can prevent the lubricating oil 12 inside the crank chamber 13 from entering the communicating passage 68 when the engine body 11 is tilted downward such that the communicating passage 68 is positioned beneath the axis of the cylinder bore 16. The lubricating oil 12 inside the crank chamber 13 therefore does not enter the second breather chamber 66 from the first through passage 65 via the first breather chamber 64 and the communicating passage 68.

As a result, the lubricating oil 12 inside the crank chamber 13 does not enter the second breather chamber 66 regardless of the attitude of the engine body 11 when the engine body 11 is tilted downward so that the axis of the cylinder bore 16 becomes almost horizontal. It is possible to reliably prevent the lubricating oil 12 from entering the intake system 39 and white smoke from being discharged from the exhaust muffler 40 when the engine E is started, thus contributing to an enhancement of the exhaust properties.

Furthermore, because the first and second breather chambers 64 and 66 are provided in the engine body 11 in the arrangement of the present invention in order to prevent the lubricating oil 12 from entering the intake system 39, the overall dimensions of the engine E do not increase.

The second through passage 67 is formed from the through hole 85, which is directly formed in the first case half 22 of the engine body 11 so as to communicate with the second breather chamber 66, and the pipe 86 is secured to the first case half 22 so as to communicate with the through hole 85. The second through passage 67, which has a complex shape so that its open end is positioned above the oil surface inside the crank chamber 13 regardless of the attitude of the engine body 11 when the engine body 11 is tilted over so that the axis of the cylinder bore 16 becomes almost horizontal, can be formed by a simple arrangement.

One embodiment of the present invention has been described above, but the present invention is not limited by the above-mentioned embodiment and can be modified in a variety of ways without departing from the spirit and scope of the claims.

For example, in the above-mentioned embodiment in order to prevent the lubricating oil 12 inside the crank chamber 13 from entering the communicating passage 68 when the engine body 11 is tilted downward so that the communicating passage 68 is positioned beneath the axis of the cylinder bore 16, the shape of the labyrinth-forming wall 74 inside the first breather chamber 64 is specially designed so as to prevent the lubricating oil 12 inside the crank chamber 13 from entering the communicating passage 68. However, it is also possible to form the first through passage 65 so that the open end of the first through passage 65 inside the crank chamber 13 is always positioned above the oil surface L of the lubricating oil 12 inside the crank chamber 13.

The application of the present invention is not limited to the rammer 10 and the present invention can be put into practice widely in any field relating to a work machine that is connected to the crankshaft 14 so that the axis of the cylinder bore 16 becomes almost vertical when the machine is used.

What is claimed is:

1. A breather structure in a four-cycle engine for a work machine in which a crankcase of an engine body rotatably supports a crankshaft linked to the work machine, lubricating oil is stored in a crank chamber formed inside the crankcase, and an intake system is connected to a cylinder head of the engine body, the axis of a cylinder bore of the engine body being almost vertical when the work machine is being used, the breather structure including:

a first breather chamber;

a first through passage for providing communication between the first breather chamber and the crank chamber;

a second breather chamber placed in the vicinity of the intake system on the side approximately opposite to the first breather chamber relative to the axis of the cylinder bore;

a second through passage for providing communication between the second breather chamber and the crank chamber; and a communicating passage for providing communication between the first and second breather chambers, wherein the first breather chamber, the first through passage, the second breather chamber, the second through passage and the communicating passage are provided in the engine body so that the first and second through passages communicate with the lower parts of the first and second breather chambers that are positioned above the oil surface inside the crank chamber when the work machine is being used and the communicating passage opening into the upper part of the second breather chamber, wherein a guide pipe that communicates with the upper part of the second breather chamber when the work machine is being used is connected to the intake system, wherein the second through passage is formed so that an open end of the second through passage inside the crank chamber is positioned above the oil surface inside the crank chamber regardless of the attitude of the engine body when the engine body is tilted downward so that the axis of the cylinder bore becomes almost horizontal, and wherein the route from the first through passage to the communicating passage via the first breather chamber is shaped so as to prevent the lubricating oil inside the crank chamber from entering the communicating passage when the engine body is tilted downward so that the communicating passage is positioned beneath the axis of the cylinder bore.

2. A breather structure in a four-cycle engine for a work machine according to claim 1, wherein the second through passage is formed from a passage hole that is directly provided in the engine body so as to communicate with the second breather chamber and a pipe that is secured to the engine body so as to communicate with the passage hole.

* * * * *